US012024343B2

(12) United States Patent
Okude et al.

(10) Patent No.: US 12,024,343 B2
(45) Date of Patent: Jul. 2, 2024

(54) PAPER-MADE CONTAINER FOR ACCOMMODATING LIQUID CONTENT FOR REFILLING

(71) Applicant: NIPPON PAPER INDUSTRIES CO., LTD., Tokyo (JP)

(72) Inventors: Hideki Okude, Tokyo (JP); Takaharu Noda, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 78 days.

(21) Appl. No.: 16/498,058

(22) PCT Filed: Mar. 28, 2018

(86) PCT No.: PCT/JP2018/012929
§ 371 (c)(1),
(2) Date: Sep. 26, 2019

(87) PCT Pub. No.: WO2018/181551
PCT Pub. Date: Oct. 4, 2018

(65) Prior Publication Data

US 2020/0102114 A1 Apr. 2, 2020

(30) Foreign Application Priority Data

Mar. 30, 2017 (JP) ..... 2017-068855

(51) Int. Cl.
*B65D 5/40* (2006.01)
*B65D 5/06* (2006.01)

(52) U.S. Cl.
CPC ..... *B65D 5/40* (2013.01); *B65D 5/064* (2013.01)

(58) Field of Classification Search
CPC ..... B65D 5/40; B65D 5/42; B65D 5/4204
(Continued)

(56) References Cited

U.S. PATENT DOCUMENTS 2,469,535 A * 5/1949 Williamson ..... B65D 5/0227 229/184
4,102,486 A * 7/1978 Focke ..... B65B 19/226 229/184

(Continued)

FOREIGN PATENT DOCUMENTS

JP 10-147335 6/1998
JP 2009-520652 5/2009

(Continued)

OTHER PUBLICATIONS

International Search Report issued Jun. 12, 2018 in International (PCT) Application No. PCT/JP2018/012929.

*Primary Examiner* — Anthony D Stashick
*Assistant Examiner* — Raven Collins
(74) *Attorney, Agent, or Firm* — Wenderoth, Lind & Ponack, L.L.P.

(57) ABSTRACT

A paper inner container for storage of a refilling liquid content, the paper inner container including a body (11), which includes a body front panel (7), a body right side panel (6), a body left side panel (8), and a body back panel (5). A top surface (12) includes: a top surface forming panel (14) which is continuously provided on an upper edge of the body back panel; a top surface formation assisting panel (16), which is continuously provided on an upper edge of the body front panel, and is folded up on a lower side of the top surface forming panel; and right and left side panels (19, 20), which are continuously provided on upper edges of the body right side panel and the body left side panel, and are folded up along with overlapping of the top surface forming panel and the top surface formation assisting panel.

3 Claims, 13 Drawing Sheets

(58) Field of Classification Search
USPC ..... 220/269; 229/159, 137
See application file for complete search history.

(56) References Cited

U.S. PATENT DOCUMENTS

| | | | | | |
|---|---|---|---|---|---|
| 5,439,106 | A * | 8/1995 | Focke | B65B 19/228 | 229/159 |
| 5,803,349 | A * | 9/1998 | Ljungstrom | B65D 5/068 | 229/125.42 |
| 9,382,031 | B2 * | 7/2016 | Ward, Jr. | B65D 5/18 | |
| 2008/0272121 | A1 * | 11/2008 | Rosentreler | B65D 5/746 | 220/269 |
| 2016/0288949 | A1 * | 10/2016 | Weymer | B65D 5/563 | |

FOREIGN PATENT DOCUMENTS

| | | | | |
|---|---|---|---|---|
| JP | 2017-43382 | 3/2017 | | |
| KR | WO2010002079 | * 12/2008 | B65D 5/40 | |
| WO | 2017/033509 | 3/2017 | | |

* cited by examiner

PAPER-MADE CONTAINER FOR ACCOMMODATING LIQUID CONTENT FOR REFILLING

TECHNICAL FIELD

The present invention relates to a paper inner container for storage of a refilling liquid content, which is to be accommodated for use in a refillable container.

BACKGROUND ART

Asa refillable container capable of being refilled with a liquid content, there has been known a refillable container including a container that is prepared as an inner container to store a refilling liquid content therein. The liquid content in the inner container is dispensed under a state in which the inner container is accommodated in the refillable container. When the liquid content in the inner container is used up, the inner container is taken out from the refillable container, and the inner container is replaced with a new inner container. In this manner, refilling is performed.

As the inner container to be used in such a refillable container, the applicant of the present application has proposed a paper inner container as illustrated in FIG. 11 (see Patent Literature 1). Specifically, the paper inner container is made of a paper material having a thermoplastic resin laminated on its both surfaces, and includes: four body panels, which form a body 51 having a square tubular shape by coupling an edge of one of the four body panels to a vertical direction sealing panel 50; and a pair of top surface forming panels 53 and 54 and a pair of side panels 55 and 56, which are continuously provided on upper edges of the body panels to form a top surface 52 of the inner container, in which the pair of top surface forming panels 53 and 54 face each other and overlap in a vertical direction, in which the pair of side panels 55 and 56 are positioned between the top surface forming panels 53 and 54 to face each other and folded up along with overlapping of the top surface forming panels 53 and 54, in which the top surface forming panels 53 and 54 have holes 57*a* and 57*b*, which are formed at centers of the top surface forming panels 53 and 54 to serve as a suction port 57, in which the hole 57*b* is sealed by a tearable film 58, and in which a periphery of a lower top surface forming panel 54 of the top surface forming panels 53 and 54, an upper top surface forming panel 53 of the top surface forming panels 53 and 54, and the side panels 55 and 56 are bonded to each other to seal the paper inner container.

For the bonding of the periphery of the lower top surface forming panel 54, the upper top surface forming panel 53, and the side panels 55 and 56 to each other to seal the paper inner container, a sealing panel 59 which is bonded to an inner surface of the upper top surface forming panel 53 to seal the paper inner container is continuously provided on an upper edge of the lower top surface forming panel 54. The lower top surface forming panel 54 is folded inwardly, and the side panels 55 and 56 are folded up in a triangular shape toward the inner surface side. Then, the sealing panel 59 continuously provided on the upper edge of the lower top surface forming panel 54 is brought upright and pressed against the inner surface of the upper top surface forming panel 53 to be bonded through thermal welding to seal the paper inner container. Moreover, both side edges of the lower top surface forming panel 54 and the side panels 55 and 56 folded up in a triangular shape are bonded to each other through thermal welding to seal the paper inner container.

CITATION LIST

Patent Literature 2017-43382 A

SUMMARY OF INVENTION

Technical Problem

With regard to the paper inner container to be used in the refillable container described in Patent Literature 1, for the bonding of the periphery of the lower top surface forming panel 54 forming the top surface 52, the upper top surface forming panel 53, and the side panels 55 and 56 to each other to seal the paper inner container, the lower top surface forming panel 54 is folded inwardly, and the side panels 55 and 56 are folded up in a triangular shape toward the inner surface side. Then, the sealing panel 59 continuously provided on the upper edge of the lower top surface forming panel 54 is brought upright and pressed against the inner surface of the upper top surface forming panel 53 to be bonded through thermal welding to seal the paper inner container. Moreover, both side edges of the lower top surface forming panel 54 and the side panels 55 and 56 folded up in a triangular shape are bonded to each other through thermal welding to seal the paper inner container. Thus, as illustrated in FIG. 12, under the state in which the sealing panel 59 is brought upright and pressed against the inner surface of the upper top surface forming panel 53, at a corner portion between the upper top surface forming panel 53 and each of the side panels 55 and 56, there is formed a fold-up portion 59*a*, which has a plurality of overlapping surfaces due to overlapping of a mountain-folded portion and a valley-folded portion.

Therefore, at the time of sealing, the fold-up portion 59*a* is strongly pressurized in order to improve heat transmission. However, when the pressure is excessively strong, a thermoplastic resin given at the fold-up portion 59*a* of the sealing panel 59 is torn. As a result, thermal welding may become insufficient to cause formation of unsealed portions, and there is a fear of causing liquid leakage.

Further, the top surface forming panels 53 and 54 forming the top surface 52 of the inner container face each other and overlap in the vertical direction, and hence it is required that the holes 57*a* and 57*b* which serve as the suction port 57 be formed in both of the top surface forming panels 53 and 54. Therefore, it is required that the holes 57*a* and 57*b* be formed with care so that the holes 57*a* and 57*b* match with each other when the top surface forming panels 53 and 54 overlap each other, which makes manufacture be cumbersome.

An object of the present invention is to provide a paper inner container for storage of a refilling liquid content, which is capable of achieving reliable sealing with a top surface, eliminating a fear of liquid leakage, and enabling easy manufacture.

Solution to Problem

In order to achieve the above-mentioned object, according to a first aspect of the invention, there is provided a paper inner container for storage of a refilling liquid content, which has a suction port that is formed in a top surface and allows insertion of a suction tube of a pump configured to pump up a liquid content and to dispense the liquid content to an outside of the paper inner container, the paper inner container including a body, which includes a body front panel, a body right side panel, a body left side panel, and a body back panel continuously provided through body vertical folding lines, and is formed into a square tubular shape in a region on the top surface side by a vertical direction sealing panel, wherein the top surface of the paper inner container includes: a top surface forming panel which is continuously provided on an upper edge of the body back panel through a horizontal folding line; a top surface formation assisting panel, which is continuously provided on an upper edge of the body front panel through a horizontal folding line, and is folded up on a lower side of the top surface forming panel to overlap with the top surface forming panel; a right side panel and a left side panel, which are continuously provided on upper edges of the body right side panel and the body left side panel through horizontal folding lines, and are folded up along with overlapping of the top surface forming panel and the top surface formation assisting panel, wherein the top surface forming panel has the suction port formed at a center thereof, the top surface formation assisting panel has a vertical length which prevents the top surface formation assisting panel from reaching the suction port formed in the top surface forming panel, and a sealing panel is continuously provided on a distal end of the top surface formation assisting panel through a horizontal folding line, and wherein the sealing panel continuously provided on the top surface formation assisting panel is valley-folded from the horizontal folding line, an inner surface of the sealing panel and an inner surface of the top surface forming panel are bonded to each other to seal the paper inner container, and the right side panel and the left side panel having been folded up are bonded to each other at respective overlapping surfaces to seal the paper inner container.

According to a second aspect of the invention, in the paper inner container for storage of a refilling liquid content according to the first aspect of the invention, the paper inner container is made of a paper material having a thermoplastic resin laminated at least on an inner surface thereof.

Advantageous Effects of Invention

According to the first aspect of the invention, the top surface formation assisting panel has a vertical length which prevents the top surface formation assisting panel from reaching the suction port formed in the top surface forming panel. The sealing panel is continuously provided on the distal end of the top surface formation assisting panel through the horizontal folding line. The sealing panel continuously provided to the top surface formation assisting panel is valley-folded from the horizontal folding line. The inner surface of the sealing panel and the inner surface of the top surface forming panel are bonded to each other to seal the paper inner container, and the right side panel and the left side panel having been folded up are bonded to each other at the respective overlapping surfaces to seal the paper inner container. Therefore, the overlapping surfaces at the fold-up portions of the sealing panel having been valley-folded from the horizontal folding line of the top surface formation assisting panel are less than the fold-up portions of the sealing panel of the paper inner container described in Patent Literature 1. Accordingly, sealing can be performed easier.

Further, in particular, when the paper inner container is made of a paper material having a thermoplastic resin laminated on its both surfaces, there are less overlapping surfaces at the fold-up portions of the sealing panel having been valley-folded from the horizontal folding line of the top surface formation assisting panel. Thus, heat transmission is excellent. Accordingly, at the time of sealing, it is not required to strongly pressurize the fold-up portions unlike the fold-up portions of the sealing panel of the paper inner container described in Patent Literature 1.

As a result, there is no fear in that the thermoplastic resin at the fold-up portions of the sealing panel is torn. Thus, the inner surface of the sealing panel continuously provided to the top surface formation assisting panel and the inner surface of the top surface forming panel can be more reliably sealed through thermal welding, thereby being capable of obtaining a paper inner container in which there is no fear of causing liquid leakage.

Moreover, the top surface formation assisting panel has a vertical length which prevents the top surface formation assisting panel from reaching the suction port formed in the top surface forming panel. Therefore, when the top surface formation assisting panel is folded up on the lower side of the top surface forming panel to overlap with the top surface forming panel, the top surface formation assisting panel does not close the suction port formed in the top surface forming panel. Therefore, there is no need to form a hole, which communicates with the suction port formed in the top surface forming panel. Accordingly, manufacture can be easily performed.

According to the second aspect of the invention, the paper inner container is made of the paper material having the thermoplastic resin laminated on at least the inner surface. Therefore, leakage of a liquid content stored therein can be prevented.

DESCRIPTION OF EMBODIMENTS

Now, one example of a paper inner container for refilling according to an embodiment of the present invention is described in detail with reference to the drawings.

Figure 1:
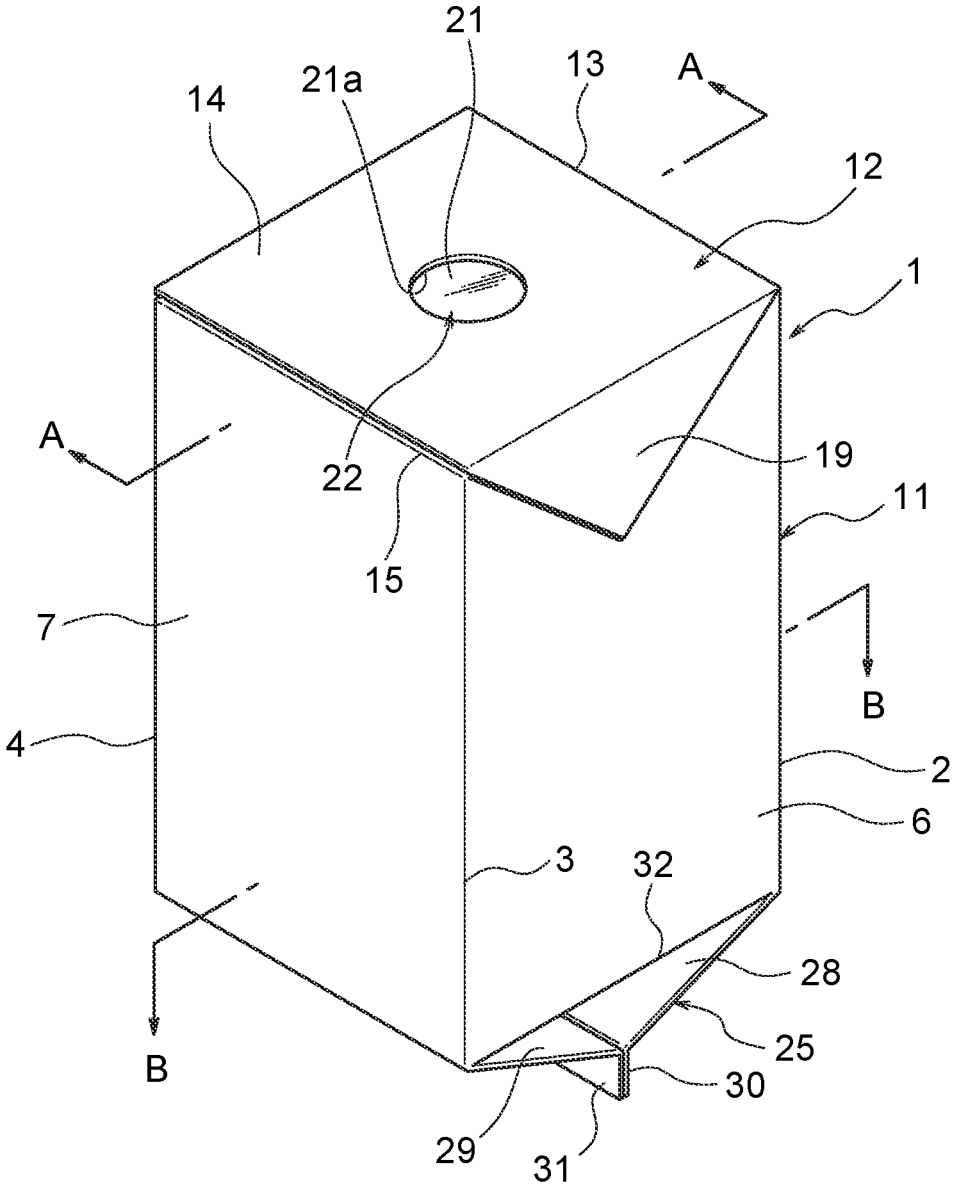
FIG. 1 is a perspective view for illustrating one example of a paper inner container for storage of a refilling liquid content according to an embodiment of the present invention.
Figure 2:
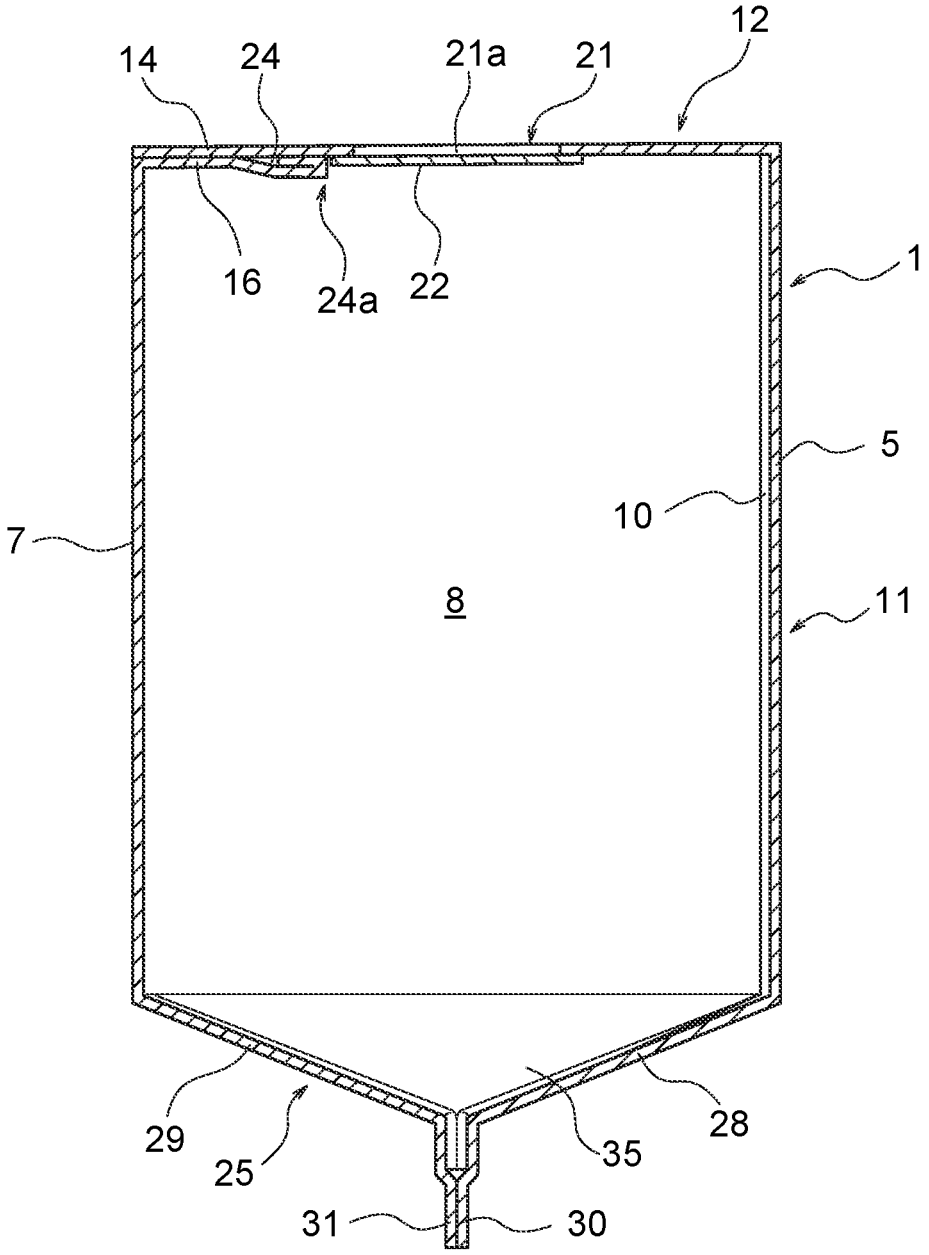
FIG. 2 is a sectional view taken along the line A-A of FIG. 1.
Figure 3:
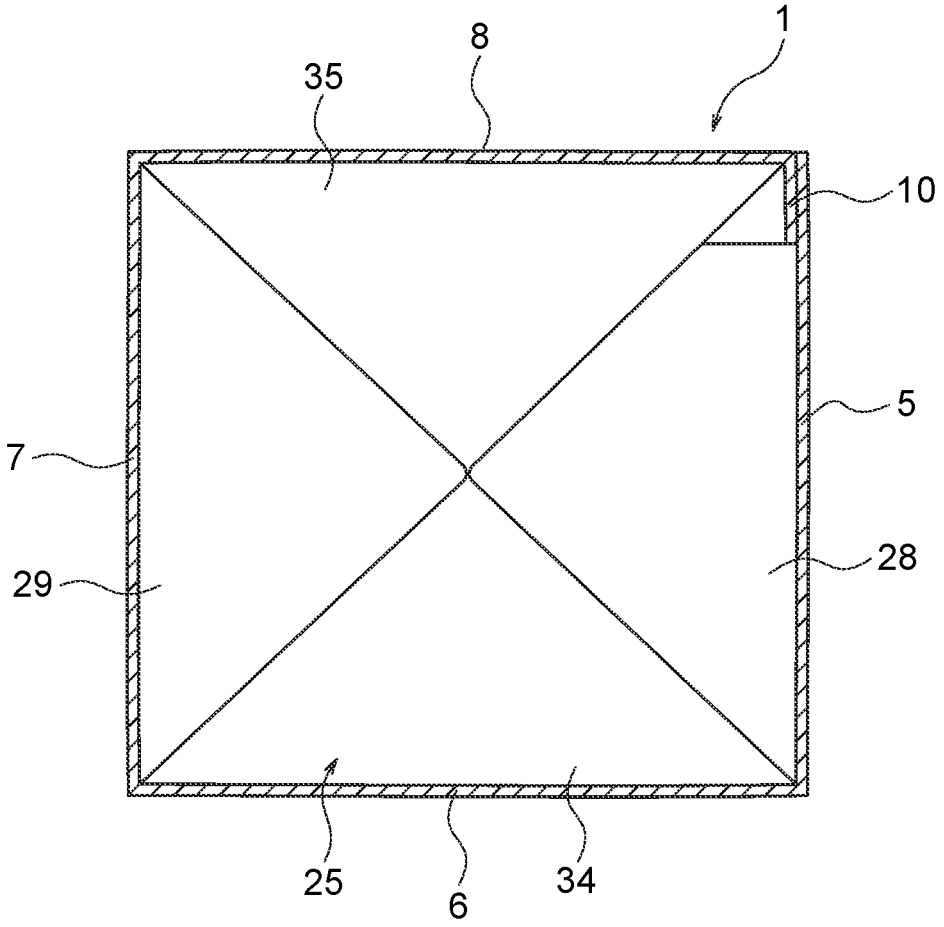
FIG. 3 is a sectional view taken along the line B-B of FIG. 1.
Figure 4:
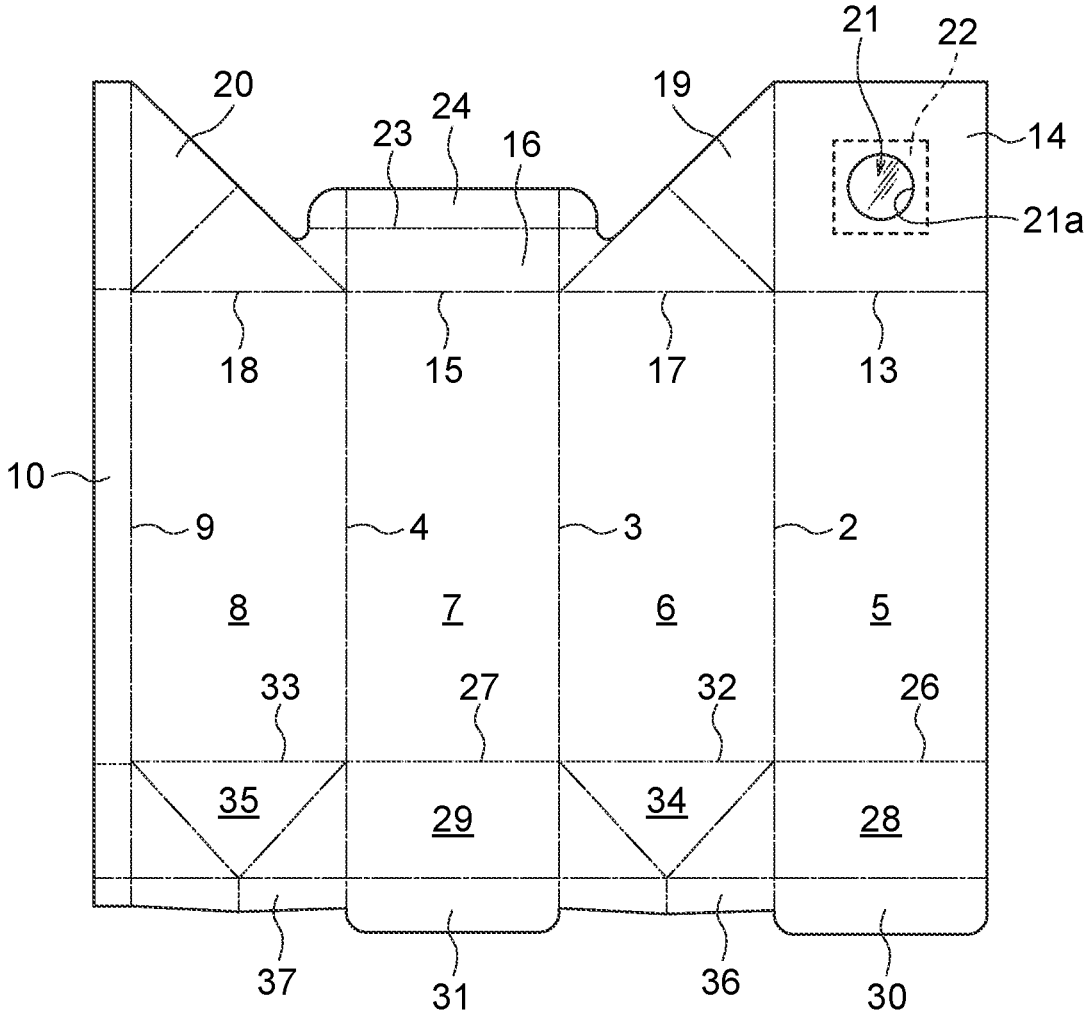
FIG. 4 is a developed view for illustrating a carton blank before being subjected to assembly processing of the paper inner container for storage of a refilling liquid content illustrated in FIG. 1.
Figure 5:
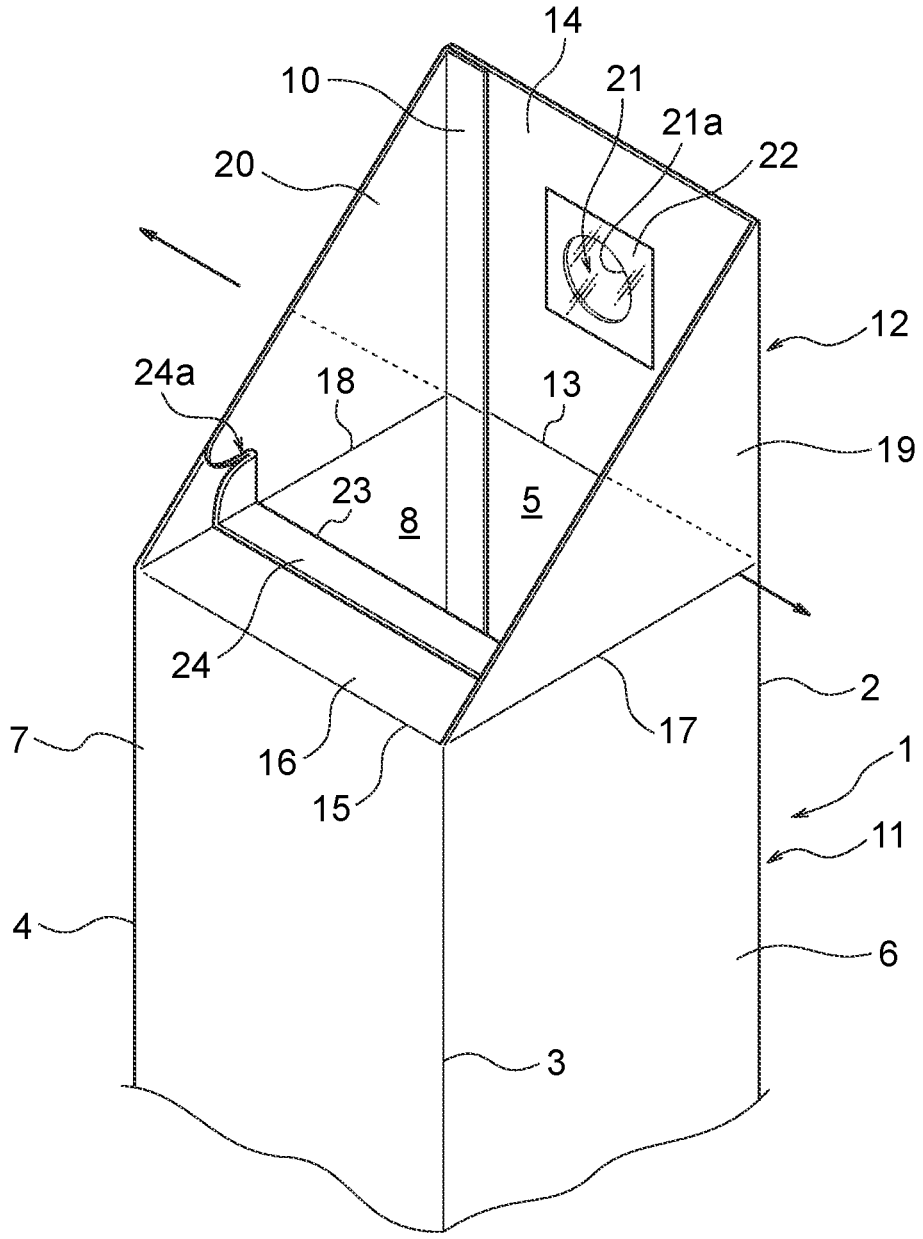
FIG. 5 is an explanatory view for illustrating a step of forming atop surface of the paper inner container for storage of a refilling liquid content illustrated in FIG. 1.
Figure 6:
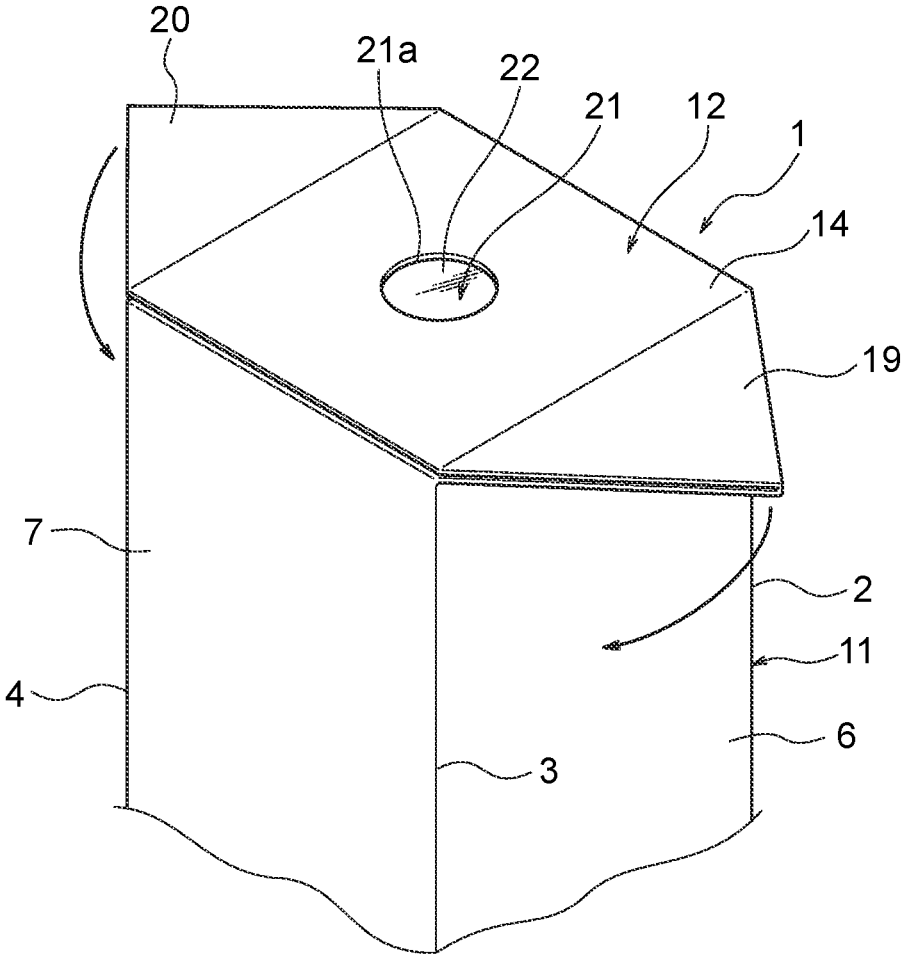
FIG. 6 is an explanatory view for illustrating a step of forming the top surface of the paper inner container for storage of a refilling liquid content illustrated in FIG. 1.
Figure 7:
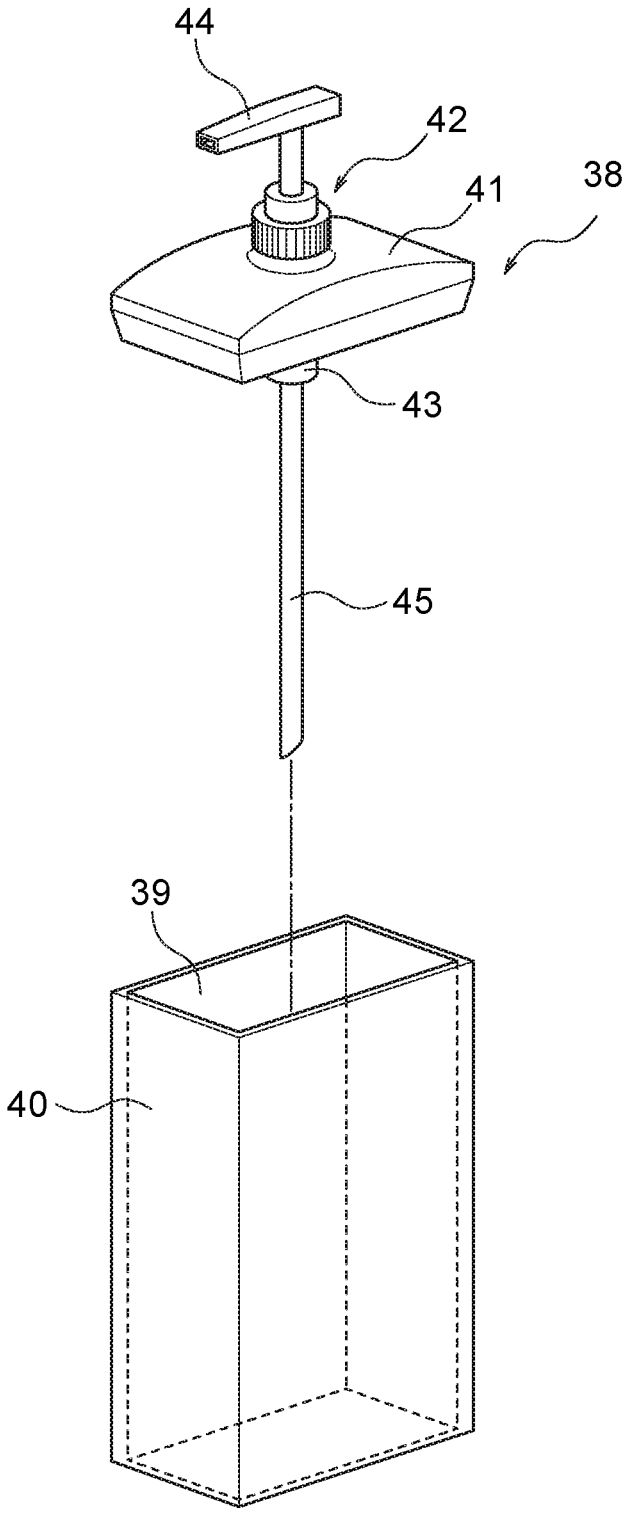
FIG. 7 is an exploded perspective view for illustrating one example of a refillable container that accommodates the paper inner container for storage of a refilling liquid content illustrated in FIG. 1.
Figure 8:
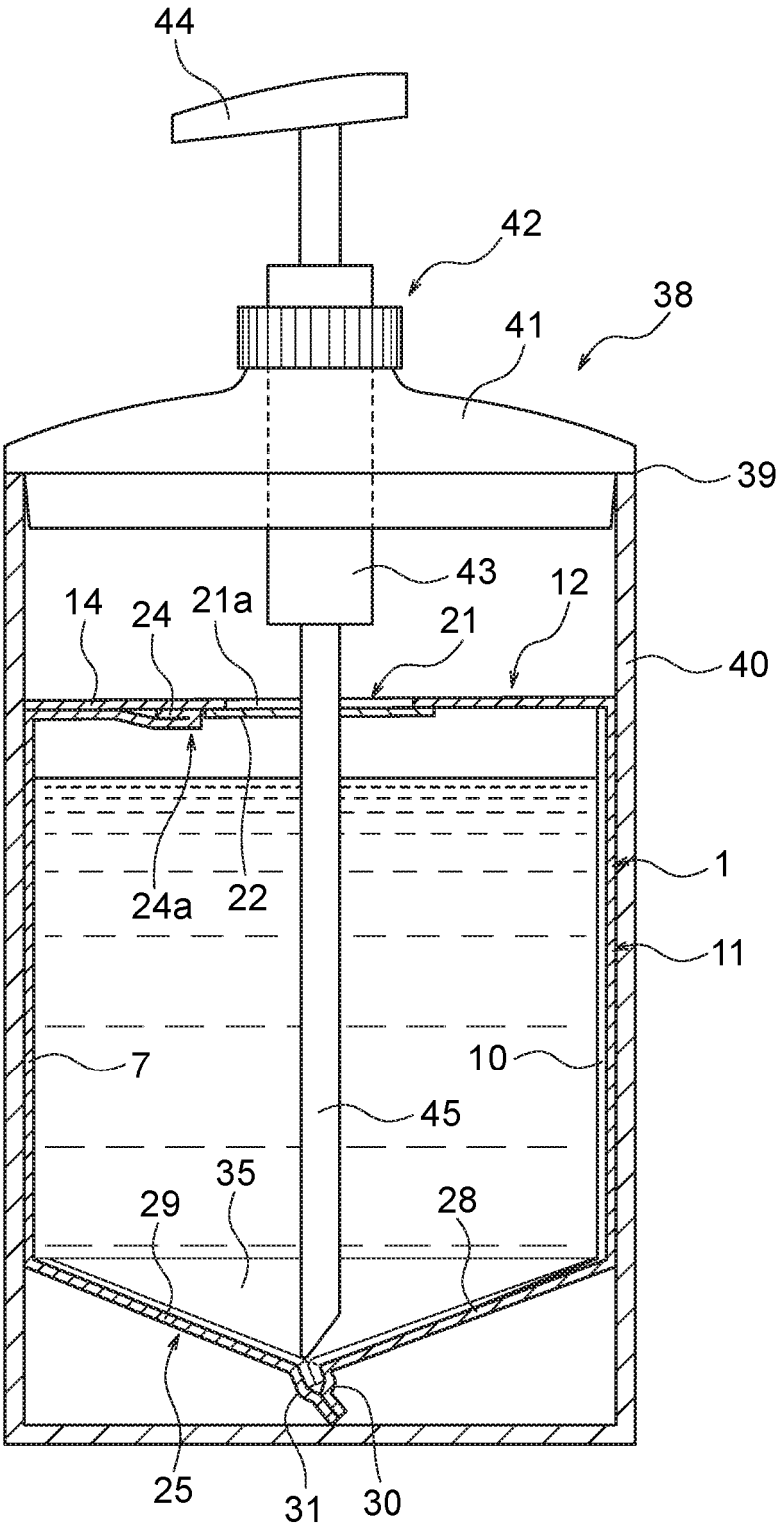
FIG. 8 is a vertical sectional explanatory view for illustrating a state in which the paper inner container for storage of a refilling liquid content illustrated in FIG. 1 is accommodated in the refillable container illustrated in FIG. 7.
Figure 9:
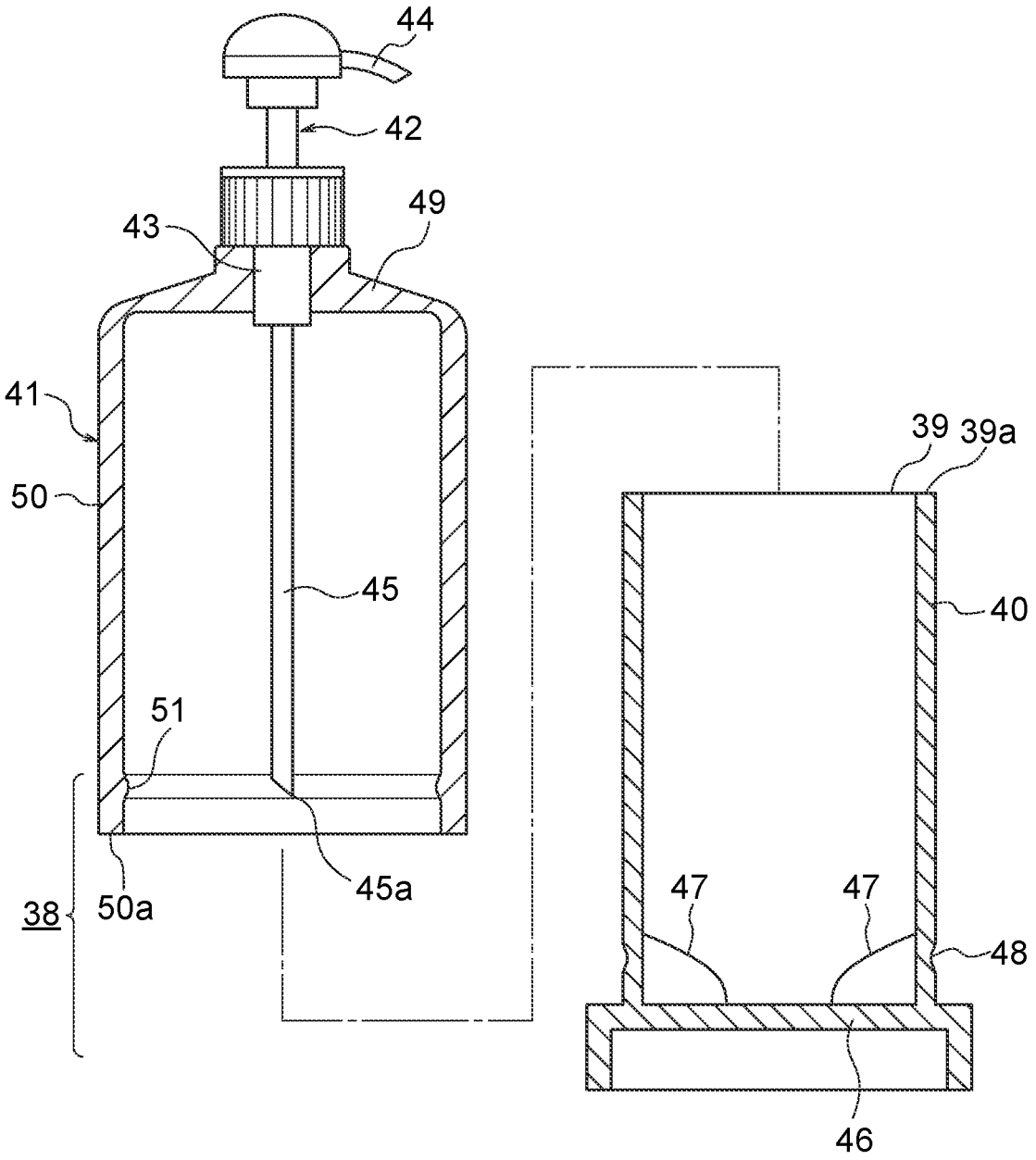
FIG. 9 is an exploded vertical sectional view for illustrating another example of a refillable container that accommodates the paper inner container for storage of a refilling liquid content illustrated in FIG. 1.
Figure 10:
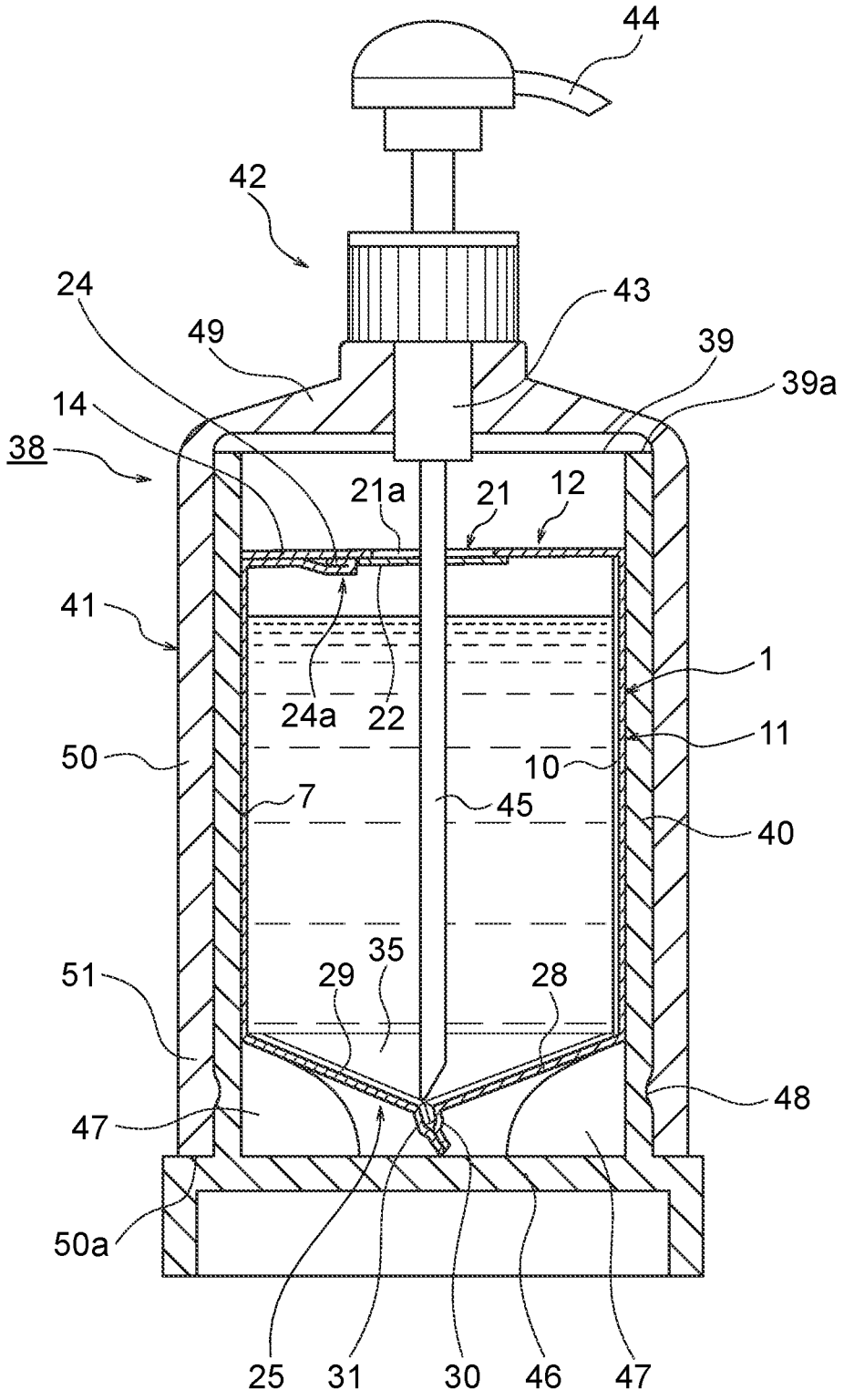
FIG. 10 is a vertical sectional explanatory view for illustrating a state in which the paper inner container for storage of a refilling liquid content illustrated in FIG. 1 is accommodated in the refillable container illustrated in FIG. 9.
Figure 11:
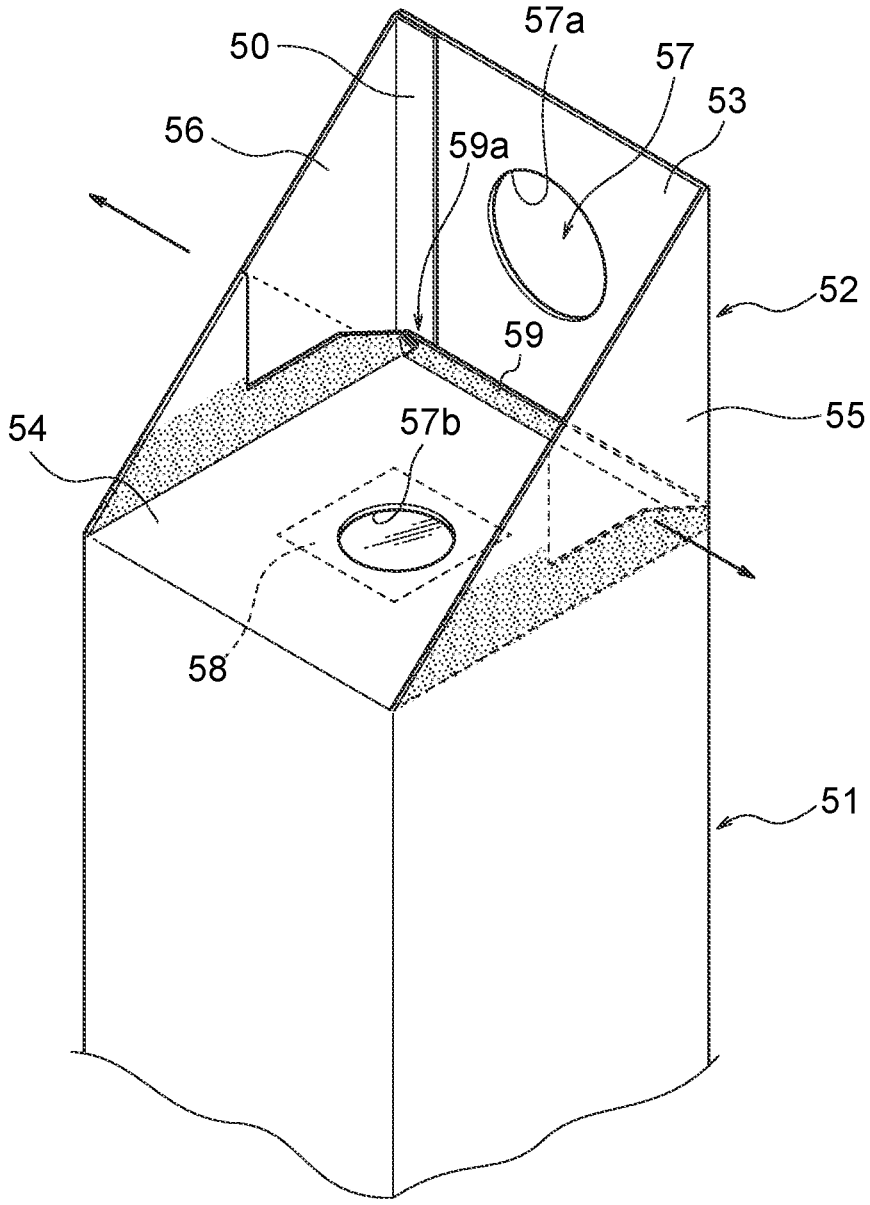
FIG. 11 is an explanatory view for illustrating a step of forming a top surface of a related-art paper inner container for storage of a refilling liquid content.
Figure 12:
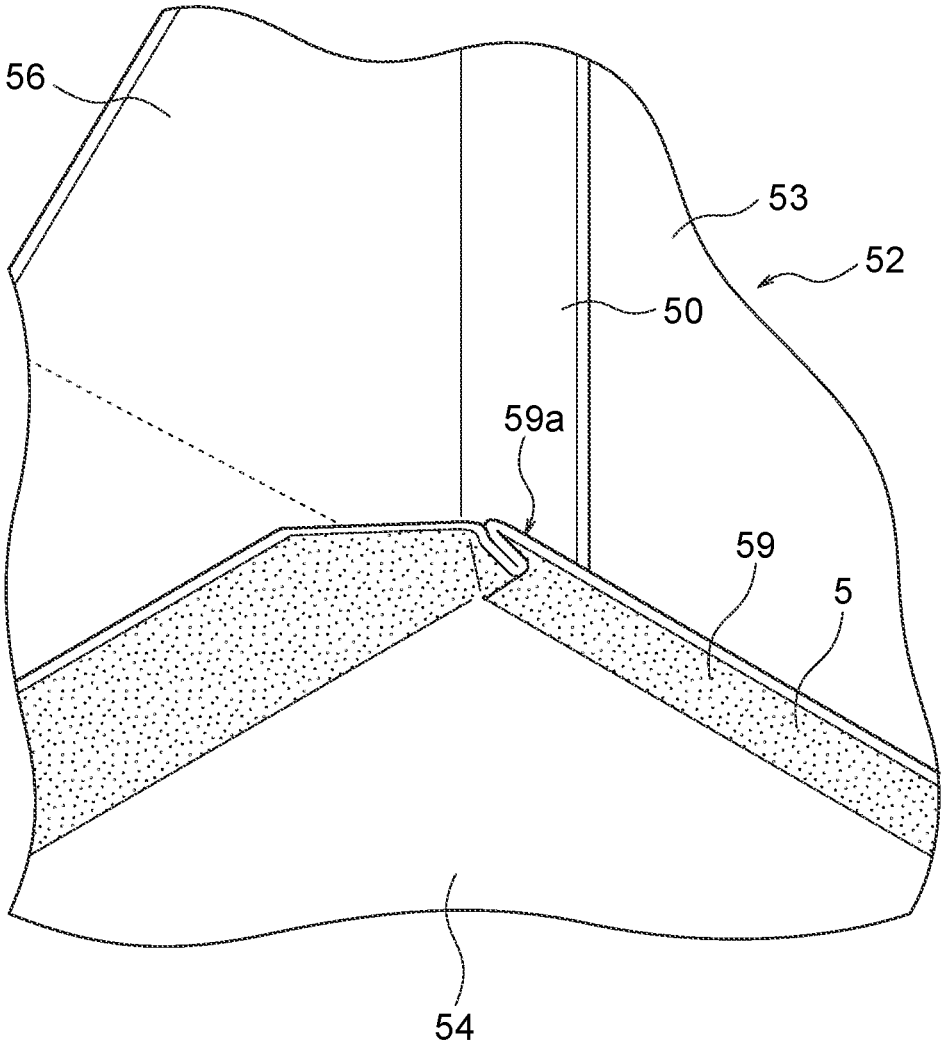
FIG. 12 is a partial enlarged view of FIG. 11.
Figure 13:
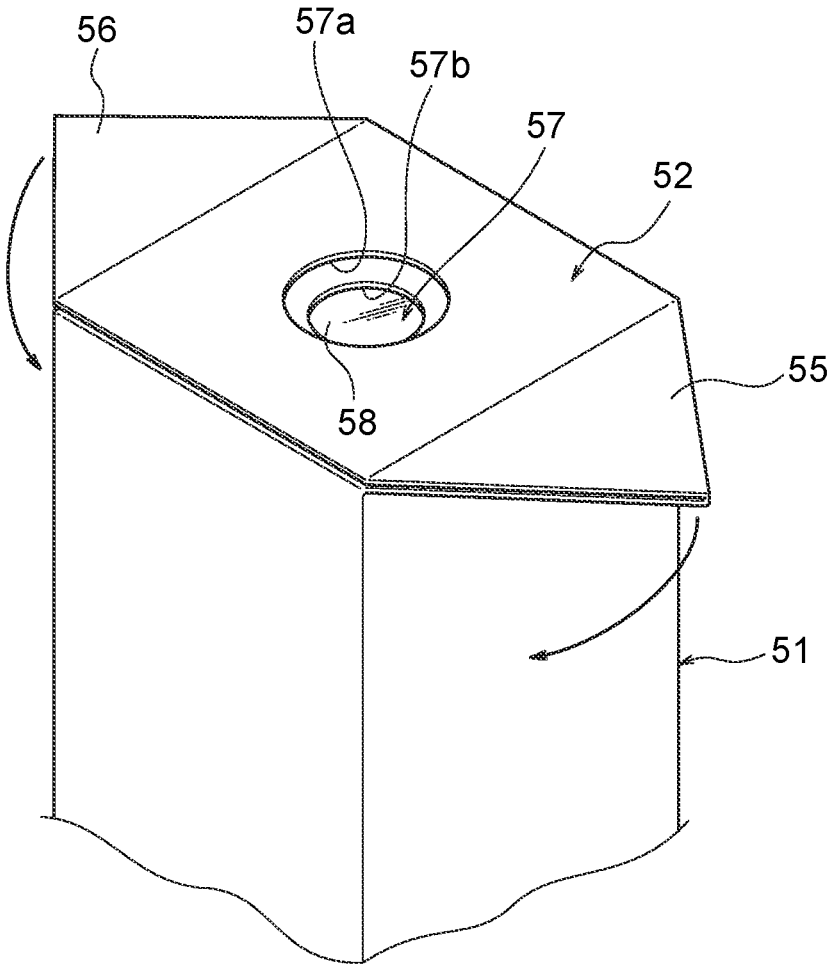
FIG. 13 is an explanatory view for illustrating a step of forming the top surface of the related-art paper inner container for storage of a refilling liquid content.

FIG. 1 is a perspective view for illustrating one example of the paper inner container for refilling according to the embodiment of the present invention. FIG. 2 is a sectional view taken along the line A-A of FIG. 1. FIG. 3 is a sectional view taken along the line B-B of FIG. 1. FIG. 4 is a developed view for illustrating a carton blank before being subjected to assembly processing of the paper inner container for refilling illustrated in FIG. 1. FIG. 5 is an explanatory view for illustrating a step of forming a top surface of the paper inner container for refilling illustrated in FIG. 1. FIG. 6 is an explanatory view for illustrating a step of forming the top surface of the paper inner container for refilling illustrated in FIG. 1. FIG. 7 is an exploded perspective view for illustrating one example of a refillable container that accommodates the paper inner container for refilling illustrated in FIG. 1. FIG. 8 is a vertical sectional explanatory view for illustrating a state in which the paper inner container for refilling illustrated in FIG. 1 is accommodated in the refillable container illustrated in FIG. 7. FIG. 9 is an exploded perspective view for illustrating one example of a refillable container that accommodates the paper inner container for refilling illustrated in FIG. 1. FIG. 10 is a vertical sectional explanatory view for illustrating a state in which the paper inner container for refilling illustrated in FIG. 1 is accommodated in the refillable container illustrated in FIG. 9.

A paper inner container 1 for refilling of this example is made of a paper material having a thermoplastic resin laminated on its both surfaces, and includes four body panels 5, 6, 7, and 8 through body vertical folding lines 2, 3, and 4. The four body panels 5, 6, 7, and 8 form a body 11 having a square tubular shape by coupling an edge of the body panel 5 to a vertical direction sealing panel 10, which is continuously provided on the body panel 8 through a seal vertical folding line 9.

In this example, the top surface 12 of the paper inner container 1 is configured as described below.

The top surface 12 of the paper inner container 1 includes: a top surface forming panel 14 which is continuously provided on an upper edge of the body back panel 5 through a horizontal folding line 13; a top surface formation assisting panel 16, which is continuously provided on an upper edge of the body front panel 7 through a horizontal folding line 15, and is folded up on a lower side of the top surface forming panel 14; and a right side panel 19 and a left side panel 20, which are continuously provided on upper edges of the body right side panel 6 and the body left side panel 8 through horizontal folding lines 17 and 18, and are folded up along with overlapping of the top surface forming panel 14 and the top surface formation assisting panel 16.

Further, a suction hole 21*a* is formed at centers of the top surface forming panels 14, respectively, to serve as a suction port 21. Further, a film 22, which is tearable, is provided on a back surface of the top surface forming panel 14 so as to seal the hole 21*a*. A suction tube of a pump described later is stuck into the film 22 so as to tear the film 22.

In this example, the film 22 configured to seal the hole 21*a* is provided on the back surface of the top surface forming panel 14, but the film 22 is not limited thereto. The film 22 maybe provided on a front surface of the top surface forming panel 14, and may be provided on each of the front and back surfaces of the top surface forming panel 14.

A known film, such as polyethylene, polypropylene, polyester, or cellophane maybe used as the film 22, but film 22 is not particularly limited thereto. When the film 22 is a thermoplastic resin, the hole 21*a* formed in the top surface forming panel 14 can be easily sealed by heat sealing. In addition, aluminum foil, paper, or the like may be laminated on the film 22 in order to improve tearability, light-blocking property, oxygen barrier property, or the like.

Moreover, the top surface formation assisting panel 16 has a vertical length which prevents top surface formation assisting panel 16 from reaching the hole 21*a* of the suction port 21 formed in the top surface forming panel 14, and a sealing panel 24 is continuously provided on a distal end of the top surface forming panel 14 through a horizontal folding line 23.

For the formation of the top surface 12 of the paper inner container 1 with the top surface forming panel 14, the top surface formation assisting panel 16, the body right side panel 6, and the body left side panel 8, after the body 11 is formed, first, the sealing panel 24 continuously provided on the distal end of the top surface formation assisting panel 16 is valley-folded from the horizontal folding line 23 to overlap with the top surface formation assisting panel 16. From this state, the top surface formation assisting panel 16 is folded inwardly, and the body right side panel 6 and the body left side panel 8 are folded up in a triangular shape toward the inner surface side along with the folding of the top surface formation assisting panel 16 (see FIG. 5).

Next, the body right side panel 6 and the body left side panel 8 are folded up outwardly (in the direction indicated by the arrows in FIG. 5) to allow the top surface forming panel 14 to overlap on the top surface formation assisting panel 16 (see FIG. 6). Further, the inner surface of the sealing panel 24 having been folded back onto the top surface formation assisting panel 16 and the inner surface of the top surface forming panel 14 are bonded to each other through thermal welding to seal the paper inner container, and the body right side panel 6 and the body left side panel 8 having been folded up are bonded to each other at respective overlapping surfaces to seal the paper inner container.

After the inner surface of the top surface forming panel 14, the inner surface of the sealing panel 24 having been folded back to overlap on the top surface formation assisting panel 16, and the respective overlapping surfaces of the body right side panel 6 and the body left side panel 8 having been folded up are bonded to each other through thermal welding to seal the paper inner container in such a manner, the body right side panel 6 and the body left side panel 8 having been folded up to project outwardly toward the body 11 are folded downwardly (in the direction indicated by the arrows in FIG. 6) and fixed to the body 11 with, for example, an adhesive. Accordingly, the top surface 12 is formed.

Further, in this example, the bottom surface 25 of the paper inner container 1 is configured as described below.

A pair of gable roof-shaped bottom surface forming panels 28 and 29, which face each other, are continuously provided on lower edges of the body back panels 5 and the body front panels 7 through bottom horizontal folding lines 26 and 27. Outer sealing panels 30 and 31, which have a belt-like shape, are continuously provided on lower parts of the gable roof-shaped bottom surface forming panels 28 and 29.

Further, a pair of gable wall-shaped bottom surface forming panels 34 and 35, which face each other, are continuously provided on lower edges of the body right side panels 6 and the body left side panels 8 through bottom horizontal folding lines 32 and 33. Inner sealing panels 36 and 37, which have a belt-like shape and a height smaller than that of the outer sealing panels 30 and 31, are continuously provided on lower parts of the gable wall-shaped bottom surface forming panels 34 and 35.

Further, the bottom surface 25 is formed by the gable roof-shaped bottom surface forming panels 28 and 29 and the gable wall-shaped bottom surface forming panels 34 and 35 as described below. The gable wall-shaped bottom surface forming panels 34 and 35 are folded in between the gable roof-shaped bottom surface forming panels 28 and 29, and facing surfaces of the outer sealing panels 30 and 31, which face each other, are bonded to each other to seal the paper inner container 1. Further, facing surfaces of the outer sealing panels 30 and 31 and facing surfaces of the inner sealing panels 36 and 37, and facing surfaces of the inner sealing panels 36 and 37 are bonded to each other to seal the paper inner container 1. Accordingly, the bottom surface 25 is formed into a reversed quadrangular pyramid shape of a so-called reversed gable top shape (see FIG. 2 and FIG. 3).

According to the paper inner container 1 configured as described above, for the formation of the top surface 12 of the paper inner container 1 with the top surface forming panel 14, the top surface formation assisting panel 16, the body right side panel 6, and the body left side panel 8, the sealing panel 24 continuously provided on the distal end of the top surface formation assisting panel 16 is valley-folded from the horizontal folding line 23 to overlap with the top surface formation assisting panel 16. From this state, the top surface formation assisting panel 16 is folded inwardly, and the body right side panel 6 and the body left side panel 8 are folded up in a triangular shape toward the inner surface side. After that, the body right side panel 6 and the body left side panel 8 are folded up outwardly to allow the top surface forming panel 14 to overlap on the top surface formation assisting panel 16. Further, the inner surface of the sealing panel 24 having been folded back onto the top surface formation assisting panel 16 and the inner surface of the top surface forming panel 14 are bonded to each other through thermal welding to seal the paper inner container. Therefore, there are less overlapping surfaces at the fold-up portions 24*a* of the sealing panel 24 having been valley-folded from the horizontal folding line 23 of the top surface formation assisting panel 16. Thus, heat transmission is excellent.

Accordingly, at the time of sealing, the thermal welding can be easily performed without strongly pressurizing the fold-up portions 24*a* of the sealing panel 24. As a result, there is no fear in that the thermoplastic resin at the fold-up portions 24*a* of the sealing panel 24 is torn.

Further, the top surface formation assisting panel 16 has a vertical length which prevents the top surface formation assisting panel 16 from reaching the hole 21*a* serving as the suction port 21 formed in the top surface forming panel 14. Therefore, when the top surface formation assisting panel 16 is folded up on the lower side of the top surface forming panel 14 to overlap with the top surface forming panel 14, the top surface formation assisting panel 16 does not close the suction port 21 formed in the top surface forming panel 14. Therefore, there is no need to form a hole, which communicates to the hole 21*a* serving as the suction port 21 formed in the top surface forming panel 14, in the top surface formation assisting panel 16.

FIG. 7 is an illustration of one example of a refillable container that accommodates the paper inner container 1 configured as described above. A refillable container 38 of this example includes: a container main body 40, which has an opening 39 in an upper part thereof and is made of plastic; a lid member 41, which is configured to close the opening 39 of the container main body 40 and is made of plastic; and a pump 42, which is provided on the lid member 41 and configured to pump up the liquid content in the paper inner container 1 accommodated in the container main body 40 and to dispense the liquid content to an outside of the refillable container.

The pump 42 includes: a tubular cylinder portion 43; a dispense nozzle 44, which is provided on an upper part of the tubular cylinder portion 43 and serves also as an operation portion for a piston that is slidably fitted into the tubular cylinder portion 43; and a suction tube 45, which is provided on a lower part of the tubular cylinder portion 43. The pump 42 is provided at a center of the lid member 41. The tubular cylinder portion 43 penetrates a center portion of the lid member 41, and is fixed to the center portion of the lid member 41. The dispense nozzle 44 is arranged above the lid member 41, and the suction tube 45 is arranged below the lid member 41.

When the opening 39 of the container main body 40 is closed by the lid member 41, the suction tube 45 arranged below the lid member 41 is inserted into the paper inner container 1 from the suction port 21 that is formed in the top surface 12 of the paper inner container 1.

FIG. 9 is an illustration of another example of a refillable container that accommodates the paper inner container 1. A refillable container 38 of this example includes: a container main body 40, which has an opening 39 in an upper part thereof and is made of plastic; a lid member 41, which is configured to close the opening 39 of the container main body 40 and is made of plastic; and a pump 42, which is provided on the lid member 41 and configured to pump up the liquid content in the paper inner container 1 accommodated in the container main body 40 and to dispense the liquid content to an outside of the refillable container.

The container main body 40 has such a length that an end surface 39*a* of the opening 39 of the container main body 40 slightly exceeds the top surface 12 of the paper inner container 1 when the paper inner container 1 is accommodated in the container main body 40. Moreover, at a bottom 46 of the container main body 40, bottom receiving portions 47 configured to receive a bottom surface 25 of the paper inner container 1 accommodated in the container main body 40 are provided.

Moreover, on an outer peripheral surface of the container main body 40, a recess portion 48 configured to engage with and separate from a protrusion prortion, which is formed on an inner peripheral surface of a tubular wall portion of the lid member 41 described later, through elastic deformation, is formed so as to extend in a circumferential direction.

Moreover, the lid member 41 includes: a top plate portion 49, which is configured to close the opening 39 of the container main body 40; and a tubular wall portion 50, which is fitted to an outer periphery of the container main body 40.

The pump 42 provided to the lid member 41 includes: a tubular cylinder portion 43; a dispense nozzle 44, which is provided on an upper part of the tubular cylinder portion 43 and serves also as an operation portion for a piston that is slidably fitted into the tubular cylinder portion 43; and a suction tube 45, which is provided on a lower part of the tubular cylinder portion 43. The pump 42 is provided at a center of the lid member 41. The tubular cylinder portion 43 penetrates the top plate portion 49 of the lid member 41, and is fixed to the top plate portion 49 of the lid member 41. The dispense nozzle 44 is arranged above the top plate portion 49, and the suction tube 45 is arranged below the top plate portion 49.

When the opening 39 of the container main body 40 is closed through fitting of the tubular wall portion 50 of the lid member 41 to an outer periphery of the container main body 40, the suction tube 45 arranged below the top plate portion 49 of the lid member 41 is inserted into the paper inner container 1 accommodated in the container main body 40. The suction tube 45 arranged below the top plate portion 49 of the lid member 41 has such a length that a distal end 45*a* thereof is positioned on an inner side of an opening end 50*a* of the tubular wall portion 50.

Moreover, the suction tube 45 has such a length that a distal end 45*a* thereof is positioned in the vicinity of the bottom surface 25 of the paper inner container 1 when the suction tube 45 is inserted into the paper container 1 accommodated in the container main body 40 by fitting the tubular wall portion 50 of the lid member 41 to the outer periphery of the container main body 40 and closing the opening 39 of the container main body 40.

Moreover, on the inner peripheral surface of the tubular wall portion 50 of the lid member 41, a protrusion portion 51 configured to engage with and separate from the recess portion 48, which is formed in the outer peripheral surface of the container main body 40, through elastic deformation when the opening 39 of the container main body 40 is closed with the lid member 41 is formed so as to extend in the circumferential direction.

When the paper inner container 1 according to the present invention is accommodated in the container main body 40 of the refillable container 38 configured as described above, the suction port 21 formed in the top surface 12 of the paper inner container 1 is positioned at a center of the opening 39 of the container main body 40 of the refillable container 38. Accordingly, irrespective of an orientation of the lid member 41 configured to close the opening 39 of the container main body 40, when the opening 39 of the container main body 40 is closed by the lid member 41, the suction tube 45 arranged below the lid member 41 is reliably inserted into the paper inner container 1 from the suction port 21 that is formed in the top surface 12 of the paper inner container 1. Thus, a replacing operation of the paper inner container 1, in which the liquid content is filled, can be performed easily.

Further, the bottom surface 25 of the paper inner container 1 is formed into the reversed quadrangular pyramid shape. Accordingly, when the liquid content in the paper inner container 1 is reduced to a small amount, the liquid content is accumulated at an apex of the reversed quadrangular pyramid shape in the bottom surface 25. When the opening 39 of the container main body 40 of the refillable container 38 is closed by the lid member 41, and the suction tube 45 arranged below the lid member 41 is inserted into the paper inner container 1, a distal end of the suction tube 45 is set to be positioned at the apex of the reversed quadrangular pyramid shape in the bottom surface 25 of the paper inner container 1 (see FIG. 10). Thus, the liquid content in the paper inner container 1 can be reliably and thoroughly sucked out.

In this example, the paper inner container 1 is formed of a paper material having a thermoplastic resin laminated on its both surfaces. However, the paper material may have a thermoplastic resin laminated only on the inner surface being a liquid-surface side. In this case, sealing is performed with an adhesive such as hotmelt or rubber glue as sealing means.

Moreover, the paper inner container 1 may be formed of, for example, coated paper having printability, a paper material having various barrier properties such as oil resistance, water resistance, an oxygen barrier property, and a water vapor barrier property, or a paper material having styrene rubber (SBR) coated thereon. Moreover, a material of the paper inner container 1 is not limited to a paper material having a wood pulp as a main raw material, and the paper inner container 1 may be formed of a paper material having a synthetic resin as a main raw material.

Moreover, in this example, as for the bottom surface 25 of the paper inner container 1, the gable wall-shaped bottom surface forming panels 34 and 35 are folded in between the gable roof-shaped bottom surface forming panels 28 and 29. The facing surfaces of the outer sealing panels 30 and 31 are bonded to each other to seal the paper inner container 1. Further, the facing surfaces of the outer sealing panels 30 and 31 and the facing surfaces of the inner sealing panels 36 and 37, and the facing surfaces of the inner sealing panels 36 and 37 are also bonded to each other to seal the paper inner container 1. Accordingly, the bottom surface 25 is formed into a reversed quadrangular pyramid shape of a so-called reversed gable top shape. However, it is only required that the bottom surface 25 be formed into a reversed polygonal pyramid shape, and the shape of the bottom surface 25 is not limited to the reversed gable top shape.

Moreover, although the bottom surface 25 of the paper inner container 1 is formed into the reversed quadrangular pyramid shape in this example, the bottom surface 25 may be formed into a reversed polygonal pyramid shape or a reversed circular cone shape from the middle of the body 11 toward the bottom surface 25.

Moreover, the paper inner container 1 may have recesses at vertical corner portions of the body 11. Through the formation of the recess at the vertical corner portions of the body 11, the strength of the body can be increased.

REFERENCE SIGNS LIST

1 paper inner container
2, 3, 4 body vertical folding line
5 body back panel
6 body right side panel
7 body front panel
8 body left side panel
9 seal vertical folding line
10 vertical direction sealing panel
11 body
12 top surface
13 horizontal folding line
14 top surface forming panel
15 horizontal folding line
16 top surface formation assisting panel

17, 18 horizontal folding line
19 right side panel
20 left side panel
21 suction port
21*a* hole
22 film
23 horizontal folding line
24 sealing panel
24*a* fold-up portion
25 bottom surface
26, 27 bottom horizontal folding line
28, 29 gable roof-shaped bottom surface forming panel
30, 31 outer sealing panel
32, 33 bottom horizontal folding line
34, 35 gable wall-shaped bottom surface forming panel
36, 37 inner sealing panel
38 refillable container
39 opening
39*a* end surface
40 container main body
41 lid member
42 pump
43 tubular cylinder portion
44 dispense nozzle
45 suction tube
45*a* distal end
46 bottom
47 bottom receiving portion
48 recess portion
49 top plate portion
50 tubular wall portion
50*a* opening end
51 protrusion portion

The invention claimed is:

1. A paper inner container for storage of a refilling liquid content, which has a suction port that is formed in a top surface and allows insertion of a suction tube of a pump, which is configured to pump up a liquid content, and to dispense the liquid content to an outside of the paper inner container, the paper inner container comprising a body, which includes a body front panel, a body right side panel, a body left side panel, and a body back panel continuously provided through body vertical folding lines, and is formed into a square tubular shape in a region on the top surface side by a vertical direction sealing panel, wherein the top surface of the paper inner container includes:

a top surface forming panel which is continuously provided on an upper edge of the body back panel through a horizontal folding line;

a top surface formation assisting panel, which is continuously provided on an upper edge of the body front panel through a horizontal folding line, and is folded up on a lower side of the top surface forming panel to overlap with the top surface forming panel;

a right side panel and a left side panel, which are continuously provided on upper edges of the body right side panel and the body left side panel through horizontal folding lines, and are folded up along with overlapping of the top surface forming panel and the top surface formation assisting panel, wherein the top surface forming panel has the suction port formed at a center thereof with respect to a length direction and a width direction of the top surface forming panel, the top surface formation assisting panel has a length which prevents a distal end of the top surface formation assisting panel from reaching the suction port formed in the top surface forming panel, a tearable film is provided on a front surface or a back surface of the top surface forming panel so as to seal the suction port, and a sealing panel is continuously provided on the distal end of the top surface formation assisting panel through a horizontal folding line, wherein a length of the sealing panel in the length direction is less than the length of the top surface formation assisting panel in the length direction, and wherein the sealing panel continuously provided on the top surface formation assisting panel is valley-folded from the horizontal folding line to overlap with the top surface formation assisting panel, the top surface forming panel is folded so as to overlap the top surface formation assisting panel and the sealing panel, and an inner surface of the sealing panel and an inner surface of the top surface forming panel are thereafter bonded to each other at a position along the inner surface of the top surface forming panel between the body front panel and the suction port to seal the paper inner container, and the right side panel and the left side panel having been folded up are bonded to each other at respective overlapping surfaces to seal the paper inner container.

2. The paper inner container for storage of a refilling liquid content according to claim 1, wherein the paper inner container is made of a paper material having a thermoplastic resin laminated at least on an inner surface thereof.

3. The paper inner container for storage of a refilling liquid content according to claim 1, further comprising gable roof-shaped bottom surface forming panels folded such that a bottom surface of the paper inner container has a gable roof shape.

* * * * *